US005819367A

United States Patent [19]

Imamura

[11] Patent Number: 5,819,367

[45] Date of Patent: Oct. 13, 1998

[54] VACUUM CLEANER WITH OPTICAL SENSOR

[75] Inventor: Nobuo Imamura, Kyoto, Japan

[73] Assignee: Yashima Electric Co., Ltd., Kyoto, Japan

[21] Appl. No.: 805,933

[22] Filed: Feb. 25, 1997

[51] Int. Cl.[6] ..... A47L 9/28

[52] U.S. Cl. ..... 15/339; 15/319; 356/438

[58] Field of Search ..... 15/319, 339; 356/438

[56] References Cited

U.S. PATENT DOCUMENTS

| | | | |
|---|---|---|---|
| 3,816,004 | 6/1974 | Bignardi | 356/438 |
| 4,937,912 | 7/1990 | Kurz | 15/339 |
| 5,163,202 | 11/1992 | Kawakami et al. | 15/339 X |
| 5,182,833 | 2/1993 | Yamaguchi et al. | 15/339 X |
| 5,319,827 | 6/1994 | Yang | 15/339 X |
| 5,542,146 | 8/1996 | Hoekstra et al. | 15/339 X |

*Primary Examiner*—Chris K. Moore
*Attorney, Agent, or Firm*—Beveridge, DeGrandi, Weilacher & Young, LLP

[57] ABSTRACT

A vacuum cleaner comprises a dust sensor having a light emitting device and a light receiving device which devices are provided at predetermined positions of a suction nozzle or a suction pipe in a condition that both devices are opposite to one another in a direction which crosses a dust suction direction by a predetermined angle. A spacer member is positioned at a predetermined accurately position the suction nozzle or the suction pipe by an engagement of with respect to a second projection member and a second concave section, and each device is positioned accurately relative to the spacer member by an engagement of a first concave section and a first projection member.

6 Claims, 5 Drawing Sheets

VACUUM CLEANER WITH OPTICAL SENSOR

BACKGROUND OF THE INVENTION

The present invention relates to a vacuum cleaner, and more particularly to a vacuum cleaner which detects a quantity of dust using a dust sensor, which dust is included within air sucked into a dust bag from a floor nozzle through a suction hose, which dust bag is housed within a vacuum cleaner body.

In the past, a vacuum cleaner having a dust sensor has been presented. Such a vacuum cleaner has an arrangement such that a dust sensor is provided at a predetermined position of an air suction path which dust sensor operates optically, and a quantity of dust is detected using the dust sensor, which dust is included within air which is sucked from a floor nozzle through a suction hose to a dust bag which is housed within a vacuum cleaner body. Therefore, a quantity of dust within a region which is to be cleaned is recognized based upon a quantity of dust which is detected using the dust sensor. And, based upon the quantity of detected dust, it is judged whether or not cleaning is finished.

A conventional dust sensor is classified into two groups. A dust sensor corresponding to one group detects a quantity of dust based upon an optical quantity of a light which passes across an air suction path. A dust sensor corresponding to the other group detects a quantity of dust based upon an optical quantity of light which is reflected or scattered by dust particles within an air suction path.

When the latter dust sensor is employed, light is reflected or scattered by dust particles. An extent of the reflected or scattered light becomes wider to some degree, while an extent of a received light by a light receiving device is narrower to some degree. Therefore, a quantity of dust is detected based upon only a part (an extremely smaller quantity with respect to an entire reflected light and an entire scattered light) of the reflected or scattered light due to dust particles. Consequently, the dust detection sensitivity of the sensor cannot be raised too much.

On the contrary, when the former dust sensor is employed, light is prevented from passing through the air suction path by dust particles. Therefore, most of the light radiated from the light emitting device passes though the air suction path so as to reach the light receiving device. Consequently, the dust detection sensitivity of the sensor can easily be raised.

Therefore, the former dust sensor is employed when a dust sensor with a high sensitivity is required.

An arrangement which is most popularly employed for the former dust sensor is one where a light emitting device is provided at a predetermined position of a wall member of a pipe which constitutes an air suction path, and a light receiving device is provided at a predetermined position in the pipe which is opposite to the light radiating device. That is, an optical axis of the light emitting device and an optical axis of the light receiving device are coincident to one another. Further, an arrangement of the light emitting device and the light receiving device is most popularly employed where, as is illustrated in FIG. 8, a through hole is formed at a predetermined position of a wall member of a pipe which constitutes an air suction path, a case made of transparent resin is inserted and housed within the through hole, and the light emitting device or the light receiving device is inserted and housed within the case.

When this arrangement is employed, a disadvantage arises in that the condition of the light emitting device and the light receiving device vary depending upon, for example, a slight error in size, a vibration given from outside of the dust sensor, and the like, so that the optical axis of the light emitting device and the optical axis of the light receiving device shift from one another. Further, a disadvantage arises in that the light emitting device and the light receiving device shift in a slipping out direction of the case, and/or the cases shift in a slipping out direction of the wall member of the pipe so that a distance between the light emitting device and the light receiving device varies. Furthermore, light radiated from the light emitting device is radiated within the pipe through a bottom wall of the case and the light radiated within the pipe is received by the light receiving device through a bottom wall of the case. Therefore, disadvantages arise in that for example, the quantity of light passing through the bottom of the case is decreased, the light is scattered, and the direction of light passing through the bottom of the case is shifted from the optical axes of the light emitting device and the light receiving device, when the bottom wall of the case has cracks, blurs, or distortions which are formed during forming of the case.

A predetermined dust detection sensitivity cannot be obtained even when any one of the above disadvantages arises.

SUMMARY OF THE INVENTION

An object of the present invention is to ensure coincidence of an optical axis of a light emitting device and an optical axis of a light receiving device with one another.

Another object of the present invention is to maintain a distance between a light emitting device and a light receiving device at a predetermined distance.

A further object of the present invention is to guide a light from a light emitting device to a light receiving device efficiently.

A vacuum cleaner according to the present invention includes a suction fan and a dust bag within a vacuum cleaner body, and guides dust with air to the dust bag through a suction path comprising a floor nozzle and a suction pipe. More particularly, the vacuum cleaner according to the invention comprises a dust sensor having a light emitting device and a light receiving device, both devices being provided at predetermined positions along the suction path under a condition that both devices are opposite to one another in a direction which is inclined by a predetermined angle with respect to a dust sucking direction. The vacuum cleaner also includes through holes for housing each of the light emitting device and the light receiving device, spacer members for housing each of the light emitting device and the light receiving device, the spacer members being housed within each through hole, and a large diametered flange provided at a base portion of each of the light emitting device and the light receiving device.

With the vacuum cleaner according to the invention, a first concave section for housing the flange member is formed in the spacer member, a first projection member for preventing the flange from slipping out of the first concave section is provided at the spacer member. Also, a second concave section is provided at a predetermined position of an outer face of the spacer member, and a second projection member for engaging the second concave section so as to position the spacer member is formed at the suction path.

When the vacuum cleaner according to the present invention is employed, the spacer member is accurately positioned at a predetermined position of the suction path by an engagement of the second projection member and the second concave section. Each of the light emitting device and the light receiving member is accurately positioned at a predetermined position of the spacer member by an engagement of the first concave section and the first projection member. Therefore, each of the light emitting device and the light receiving device is accurately positioned along the suction path and is opposite the other. And, the arrangement never shifts even when vibrations and the like are applied from outside of the dust sensor, so that a condition is continuously maintained where an optical axis of the light emitting device and an optical axis of the light receiving device are coincident to one another.

Further, the light emitting device and the light receiving device are securely provided along the suction path even when the light emitting device, the light receiving device, the spacer member and the like have dimensional tolerance. Therefore, an assembly operator having no special skill can provide the light emitting device and the light receiving device in a condition that both optical axes of the light emitting device and the light receiving device are coincident to one another, without using a special tool. Furthermore, the spacer member made of arbitrary material can be employed so as to reduce the cost of the vacuum cleaner, because the spacer member has no influence on the light propagation path between the light emitting device and the light receiving device.

DETAILED DESCRIPTION OF THE PREFERRED EMBODIMENT

Figure 1:
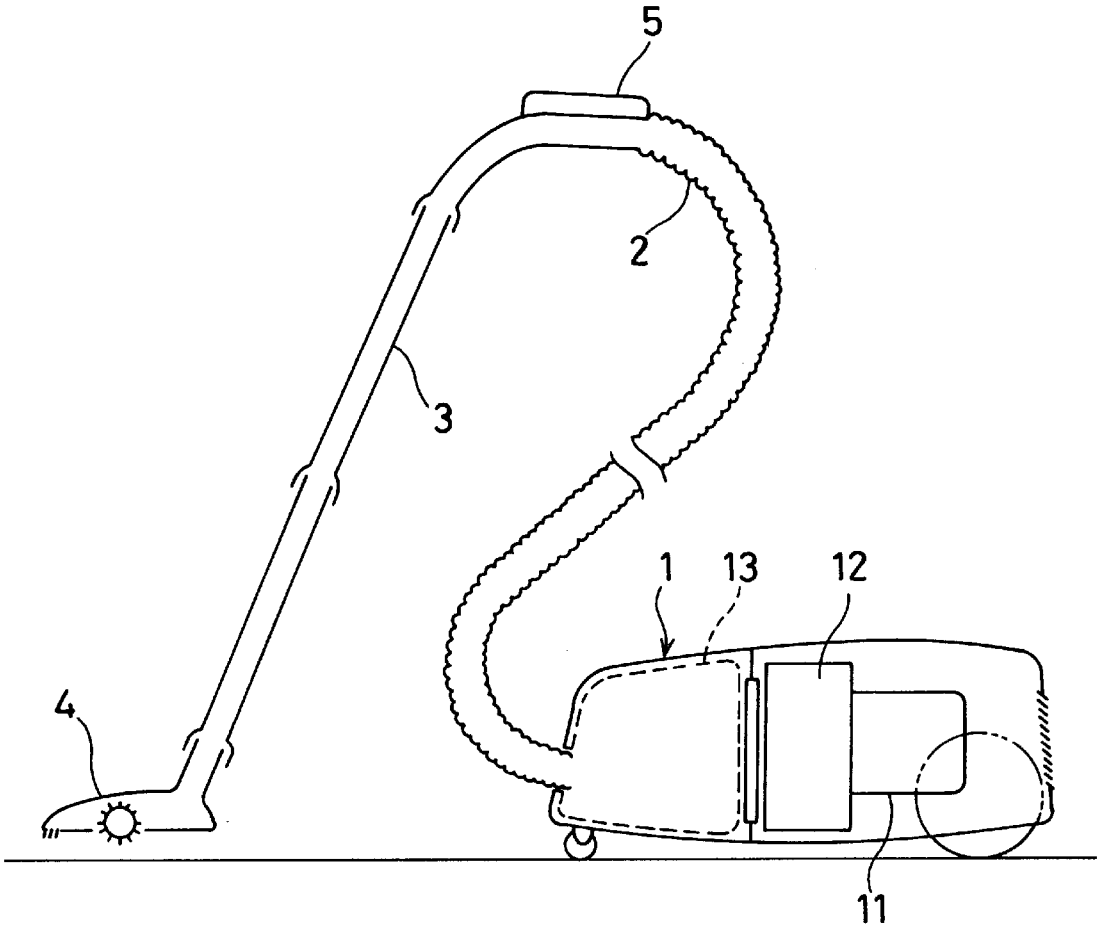
FIG. 1 is a diagram schematically illustrating a vacuum cleaner of an embodiment according to the present invention.

FIG. 1 is a diagram schematically illustrating a vacuum cleaner of an embodiment according to the present invention.

The vacuum cleaner comprises a vacuum cleaner body 1, a suction hose 2 which is provided to the vacuum cleaner body 1 in a removable manner, an extension pipe 3 which is provided to the suction hose 2 in a removable manner, and a suction nozzle (floor nozzle) 4 which is provided to a leading edge section of the extension pipe 3 in a removable manner.

The vacuum cleaner body 1 has a motor 11, a suction fan 12 which is rotated by the motor 11, a dust bag 13 for collecting dust which is included within sucked air and an electrical circuitry section for controlling the operation of each section of the vacuum cleaner.

The suction hose 2 has an operation section 5 for performing a remote operation at its leading edge section. The operation section 5 has a dust sensor 6 for detecting a quantity of sucked dust.

Figure 2:
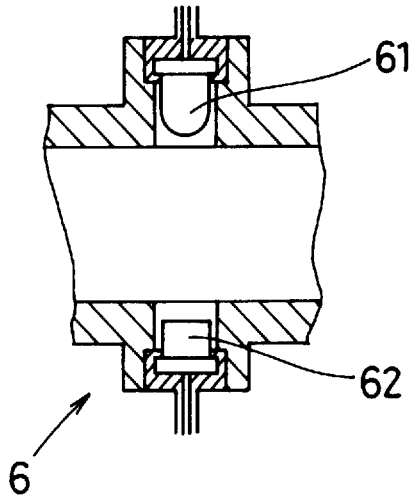
FIG. 2 is a cross sectional view illustrating a main portion of the vacuum cleaner.
Figure 3:
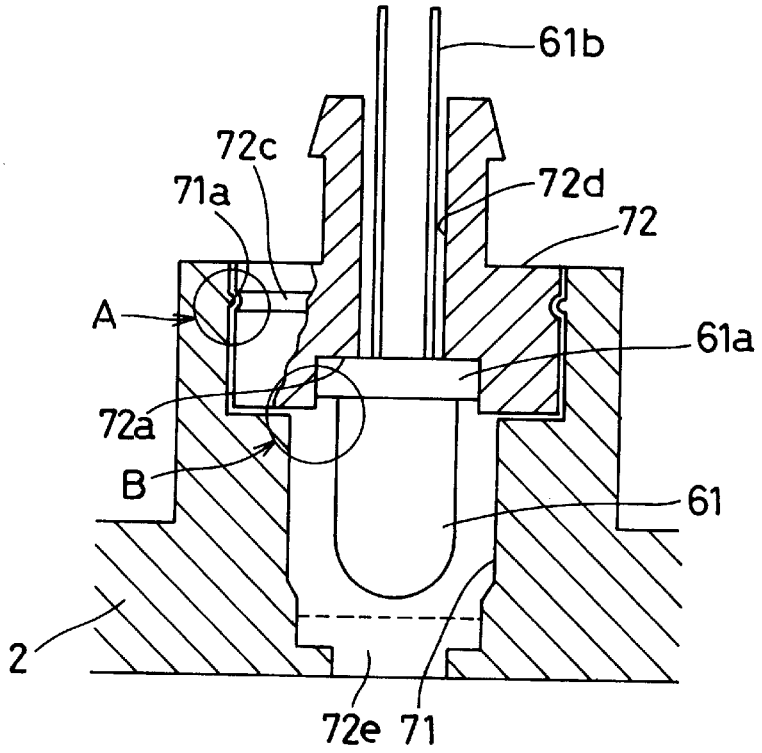
FIG. 3 is a cross sectional view illustrating an arrangement of a portion in which a light emitting device is provided.
Figure 4:
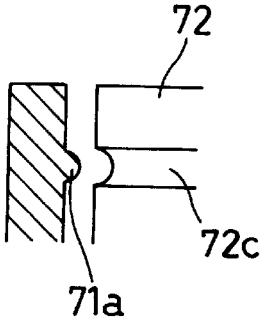
FIG. 4 is a cross sectional view illustrating a portion A of FIG. 3 in an enlarged manner.
Figure 5:
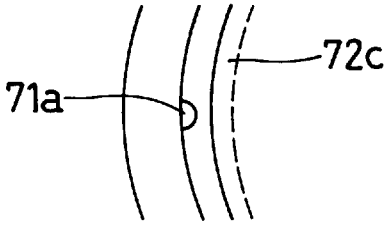
FIG. 5 is a plan view illustrating the portion A of FIG. 3 in an enlarged manner.

The dust sensor 6 has a light emitting device 61 and a light receiving device 62. Both devices 61 and 62 face one another in a direction which crosses an air flowing direction through the suction hose 2 at a right angle, as is illustrated in FIG. 2.

FIGS. 3 through 7 are diagrams illustrating the condition in which the light emitting device is provided in the operation section 5.

As is apparent from these figures, the light emitting device 61 is housed within a through hole 71 by interposing a spacer member 72 made of non-conductive material. The through hole 71 is formed at a predetermined position of a wall member of the suction hose 2.

More particularly, the light emitting device 61 has a large diametered flange 61*a* at its base section and lead wires 61*b* for supplying electric power for operation. The through hole 71 has a stepped structure at its central section so that an inner side of the through hole with respect to the suction hose 2 is formed to have a smaller diameter and an outer side of the through hole with respect to the suction hose 2 is formed to have a large diameter. A second projection member 71*a* is formed at a predetermined position of a wall member corresponding to a large diametered section of the through hole 71. The number of the second projection members is at least one, and is preferably three.

Figure 6:
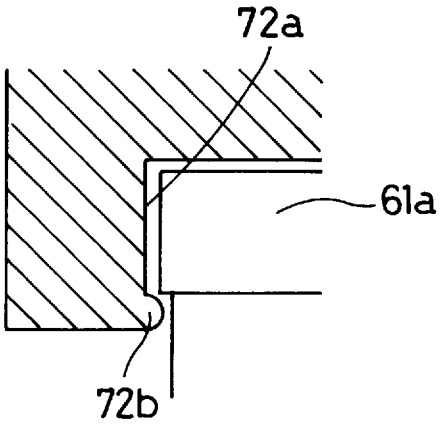
FIG. 6 is a cross sectional view illustrating a portion B of FIG. 3 in an enlarged manner.
Figure 7:
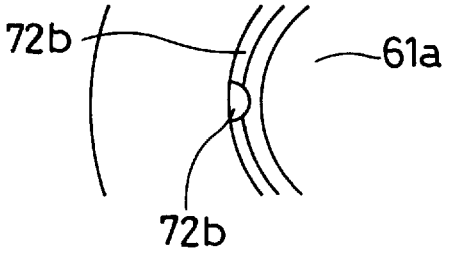
FIG. 7 is a plane view illustrating the portion B of FIG. 3 in an enlarged manner.
Figure 8:
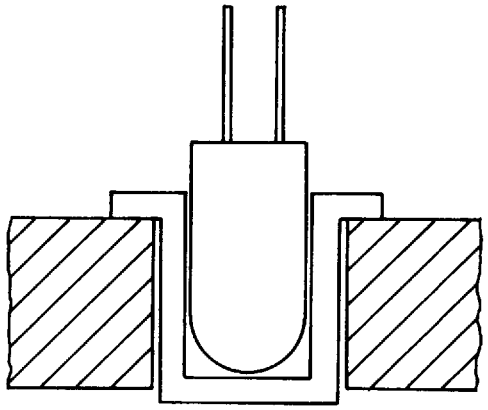
Fig.8 PRIOR ART
FIG. 8 is a cross sectional view illustrating an arrangement of a portion of a conventional vacuum cleaner in which portion a light emitting device is provided.

The spacer member 72 has an outer diameter which is nearly equal to the inner diameter of the large diametered section of the through hole 71. As may be seen in FIGS. 4 and 5, the spacer member 72 has a first concave section 72*a* for housing the flange 61*a* therein which first concave section 72*a* is formed at an inner side face of the spacer member 72 with respect to the suction hose 2. As seen in FIG. 6, the spacer member 72 also has a first projection member 72*b* for pressing the flange 61*a* to a bottom face of the first concave section 72*a*. The first projection member 72*b* is formed at a position corresponding to an opening edge section of the first concave section 72*a*. The number of the first projection members is at least one, and is preferably three.

The spacer member 72 further has a second concave section 72*c* at a predetermined position of its outer face which second concave section 72*c* can be engaged with the second projection member 71*a*. The spacer member 72 has a central hole 72*d* for passing through the lead wires 61*b* of the light emitting device 61 which central hole 72*d* communicates with the first concave section 72*a*.

The position of the second projection member 71*a* and the position of the second concave section 72*c* are determined so that the spacer member 72 is pressed to the stepped section of the through hole 71 when properly positioned in the through hole 71.

Further, the second projection member 71*a* resiliently deforms when the spacer member 72 is inserted into the through hole 71. The second projection member 71*a* restores to its original state when the second projection member 71*a* engages the second concave section 72*c* so that the spacer member 72 is prevented from slipping out from the through hole 71. The first projection member 72*b* also resiliently deforms when the flange 61*a* is inserted into the first concave section 72*a*. The first projection member 72*b* restores to its original state when the flange 61*a* is housed in its entirety within the first concave section 72*a* so that the flange 61*a* is prevented from slipping out from the first concave section 72*a*.

Furthermore, it is possible that a lens cover 72*e* made of transparent synthetic resin and the like is provided at the inner most side of the through hole with respect to the suction hose 2, as is illustrated with a dashed line in FIG. 2, so that dust is prevented from intruding into the through hole 71 by the lens cover 72*e*. A method for providing the lens cover may be similar to the method of providing the spacer member 72. Other various methods also may be employed to provide the lens cover. It is preferable, however, that the lens cover be removable.

The light receiving device 62 may be provided in the suction hose 2 in a manner similar to that of the light emitting device 61. Therefore, a specific description of the placement of the light receiving device 62 is omitted.

Operation of the vacuum cleaner having the above arrangement is as follows.

When the suction fan 12 is rotated by the motor 11, dust is sucked with air from the suction nozzle 4 through the extension pipe 3 and suction hose 2 so that only dust is collected by the dust bag 13. When light radiated from the light emitting device 61 is received by the light receiving device 62, a quantity of received light is smaller when a quantity of sucked dust is great, while a quantity of received light is greater when a quantity of sucked dust is small. Therefore, a quantity of sucked dust is detected based upon a quantity of received light. That is, based upon the quantity of detected light, it is recognized whether or not cleaning has finished.

Further, the light emitting device 61 and the light receiving device 62 are each housed within the first concave section 72*a* of a spacer member 72 so as to prevent them from slipping out of their corresponding spacer member. In addition, each spacer member 72 then is housed within the through hole 71 of the suction hose 2 so as to prevent them from slipping out of their corresponding through hole. Therefore, an optical axis of the light emitting device 61 and an optical axis of the light receiving device 62 can be maintained as coincident to one another easily and accurately. Also, a distance between the light emitting device 61 and the light receiving device 62 can be maintained at a predetermined distance easily and accurately. Furthermore, the light emitting device 61 and the light receiving device 62 are prevented from shifting their positions and the distance between the light emitting device 61 and the light receiving device 62 is prevented from varying, even when vibrations and the like are supplied from outside of the vacuum cleaner.

Further, the second concave section 72*c* may be a concave section having a narrow width formed at a position which corresponds to the second projection member 71*a*. However it is preferable that the second concave section 72*c* is a concave groove formed on an outer face of the spacer member 72. When the latter arrangement is employed, providing operation of the spacer member can be simplified.

What is claimed is:

1. A vacuum cleaner comprising, a pipe or nozzle defining a suction path of the vacuum cleaner, a dust sensor having a light emitting device and a light receiving device, both devices being provided at predetermined positions along the suction path, such that both devices are opposite one another in a direction which is at a predetermined angle with respect to a direction of the suction path, at least one through hole defined in the pipe or nozzle for housing the light emitting device or the light receiving device, the housed light emitting device or light receiving device having a flange member at a base portion thereof, a spacer member for holding the housed light emitting device or light receiving device, the spacer member being housed within each through hole, the spacer member defining a first concave section for housing the flange member, at least one first projection member for securing the flange member into the first concave section, and a second concave section provided at a predetermined position of an outer face of the spacer member for engaging at least one second projection member defined by the nozzle or pipe, so as to position the spacer member within the through hole.

2. A vacuum cleaner as set forth in claim 1, wherein the through hole is defined to have stepped shape such that a diameter of the through hole at an outer side with respect to the suction path is larger than a diameter of the through hole at an inner side with respect to the suction path.

3. A vacuum cleaner as set forth in claim 2, wherein the spacer member is housed within a section of the through hole having the larger diameter.

4. A vacuum cleaner as set forth in claim 1, wherein the first projection member is sufficiently resilient so as to permit forced insertion of the flange member into the first concave section, and the second projection member is sufficiently resilient so as to permit forced insertion of the spacer member into the through hole.

5. A vacuum cleaner as set forth in claim 4, wherein the spacer member defines a plurality of first projection members at equal angles about a circumference of the first concave section, and the nozzle or pipe defines a plurality of second projection members at equal angles about a circumference of the through hole.

6. A vacuum cleaner as set forth in claim 1, wherein the second concave section is a concave groove formed on an outer face of the spacer member.

* * * * *